US005634806A

United States Patent [19]

Hahn

[11] Patent Number: 5,634,806

[45] Date of Patent: Jun. 3, 1997

[54] INTERCHANGEABLE COLLAPSIBLE PLUG DEVICE FOR BATTERY CHARGER

[75] Inventor: Stan S. Hahn, Moraga, Calif.

[73] Assignee: Asian Micro Sources, Inc., Moraga, Calif.

[21] Appl. No.: 414,209

[22] Filed: Mar. 30, 1995

Related U.S. Application Data

[63] Continuation-in-part of Ser. No. 201,397, Feb. 24, 1994, abandoned.

[51] Int. Cl.[6] ..... H01R 29/00

[52] U.S. Cl. ..... 439/173; 439/172

[58] Field of Search ..... 439/171, 172, 439/173, 518, 52; 320/2

[56] References Cited

U.S. PATENT DOCUMENTS

| | | | |
|---|---|---|---|
| 1,485,193 | 2/1924 | McKay | 439/131 OR |
| 1,742,850 | 1/1930 | Douglas | 439/314 OR |
| 2,490,580 | 12/1949 | Colla, Jr. | 439/131 X |
| 2,538,296 | 1/1951 | Crocker | 439/131 X |
| 4,191,917 | 3/1980 | Brown et al. | 439/173 X |
| 4,518,212 | 5/1985 | Rumble | 439/221 X |
| 4,543,624 | 9/1985 | Rumble | 439/173 X |
| 4,626,052 | 12/1986 | Rumble | 439/173 OR |
| 4,743,829 | 5/1988 | Fenne et al. | 439/131 X |
| 4,911,649 | 3/1990 | Helmich, Jr. | 439/172 X |
| 4,973,827 | 11/1990 | Nozaki | 439/173 X |
| 4,997,381 | 3/1991 | Oh | 439/131 X |
| 5,159,545 | 10/1992 | Lee | 439/173 X |
| 5,213,516 | 5/1993 | Okamoto | 439/171 X |
| 5,474,464 | 12/1995 | Drewnicki | 439/172 OR |

FOREIGN PATENT DOCUMENTS

| | | | |
|---|---|---|---|
| 7600749 | 8/1976 | Netherlands | 439/221 |

*Primary Examiner*—David L. Pirlot
*Assistant Examiner*—Daniel Wittels
*Attorney, Agent, or Firm*—Adam H. Tachner; Crosby, Heafey, Roach & May

[57] ABSTRACT

An interchangeable plug device includes a casing, an electrical plug detachably mounted in the casing and movable between a detached and an operative position, and a releasable locking mechanism designed to engage the electrical plug to maintain the plug in an operative position. The locking mechanism can be released by a user to allow the plug to be moved to the detached position. A preferred form of locking mechanism is a depressible lock bar connected to or integral with an electrical plug body, which is designed to engage a detent in a casing. A preferred form of electrical connection between a detachable plug and casing comprises a submerged pin and sleeve configuration to protect the user or passerby from electric shock. A preferred form of conducting prong is collapsible within the carrier and is securable in an extended position to avoid inadvertent collapse. A variety of interchangeable electrical plugs can be fitted to the same casing. A power supply may be fitted within the casing, allowing an electrical device to be attached to the interchangeable plug device.

7 Claims, 6 Drawing Sheets

INTERCHANGEABLE COLLAPSIBLE PLUG DEVICE FOR BATTERY CHARGER

This application is a continuation-in-part of U.S. patent application Ser. No. 08/201,397, filed Feb. 24, 1994, now abandoned.

FIELD OF THE INVENTION

The present invention relates generally to an plug mechanisms and more particularly to interchangeable plug mechanisms which can be collapsed and disassembled for convenient transportation or storage and also can be used with different plugs for different sockets used in various parts of the world.

BACKGROUND OF THE INVENTION

People rely heavily on a wide variety of electrical devices. Almost all of these devices draw power ultimately from a commercial source, usually delivered to the user through a wall outlet or socket. While many electrical devices are sold for use throughout the world, there is no world standard for electrical plug configurations, size, shape, position or number of prongs. The wide variety of socket configurations in use worldwide burdens international suppliers of products to varied countries and international travellers who wish to use electrical devices in varied locations.

Most industrial nations use a standardized alternating current supply with a hot side and a neutral side. Some plugs specifically incorporate a separate earth or ground lead while others do not. While there is no world standard for power supply voltage or frequency, many electronic devices, and essentially all battery powered electrical devices, ultimately run on direct current, so it is not too difficult to design a "universal" power supply that converts 100–240 volts AC at 50–60 Hertz into a direct current suitable for a particular application. A problem remains, however, with physically accessing an AC current source supplied through any number of outlet configurations.

Differing plug configurations have posed a problem to manufacturers who sell equivalent products into various parts of the world. Plug diversity is also a significant problem for people who travel to different parts of the world and need to take electrical devices with them, particularly devices such as hair dryers, electronic cameras, phones or computers.

The traditional solution for the mechanical configuration problem is to provide an adapter which includes a socket to accommodate the prongs of the electrical device integrated with a second set of prongs in a configuration for a local socket. These adapters suffer from some significant problems. The most important is that the adapters are bulky and at a minimum cause the prongs of the original device to be extended by at least the length of the additional set of prongs. Since most plug devices are designed to be secured by spring tension and interaction with a wall plug, this can pose a significant mechanical disadvantage. The increased lever arm created by the additional prong length will tend to shift the plug downward, tending to pry the plug out of the wall socket. This will be true even for a light weight plug.

The lever arm problem is accentuated with devices that are larger than a simple plug. Many battery chargers or power supplies are designed to be wall-mounted at a wall socket. A typical device includes a casing which terminates in a plug designed to plug directly into the wall socket. The casing is often designed to lie against a wall to provide mechanical stability and to maintain the plug prongs in proper contact with the wall socket. If an adapter must be used, the unit loses the stability of resting against the wall and, because even a small amount of weight at the end of a lever arm will create a torque which will tend to pry the prongs out of the wall socket, such a plug adapter is generally unusable for such wall amounted plug-in devices.

Angling the plug severely can compromise the electrical connection to the point that the plug no longer is in electrical contact with source current. This type of angling may lead to partial separation from the wall socket and may expose the prongs of the plug in such a way that a person or animal might come into contact with live current, thereby causing bodily harm.

A further problem with existing plugs is the awkward shape of the plug with prongs protruding from the end. If, for example, a plug is moved from location to location, the prongs of the plug extend outward and can be difficult to pack or store or can catch on clothing when packed into a travel case.

A few plug devices have been designed with a plug or prongs which fold into a casing. For example, some rechargeable flashlights include the collapsible prongs which can be rotated into a position extending out from the body of the flashlight and plugged directly into a wall socket or extension cord. In another example, some telephone charging stations include a cradle for the telephone and a rotatable plug which can be extended into position for plugging into a wall socket, or collapsed into a space in the shell of the charging station, particularly so that a user may slip a charging station into a pocket, a briefcase, or other container.

Presently available collapsible plug devices suffer from various problems which make them inconvenient or even dangerous to use. In particular, the rotatable plug has only a weak spring holding the plug in position. It does not take much effort to collapse the plug, which may cause the plug to partially or completely pull out of a wall socket. This can compromise the electrical connection to the point that the plug no longer is in electrical contact with source current. In some circumstances, this may expose the prongs of the plug in such a way that a person, might come into contact with live current, thereby causing bodily harm. In addition, a collapsing plug might pinch the user.

The new device of this invention overcomes these problems by providing a plug device which can be securely maintained in the extended position but folded easily to a compact, collapsed position. This collapsible prong feature is incorporated within an interchangeable plug device which can be designed for use in a variety of plug configurations and still provide the mechanical advantages of fitting closely to the socket and, generally, against a wall. Moreover, the inventive device provides a safe means for deriving current from an interchangeable plug while minimizing the risk of exposure to a live prong or connector.

SUMMARY OF THE INVENTION

The present invention is an interchangeable plug device including a casing, an electrical plug detachably mounted in the casing and movable between a detached and an engaged, operative position, and a releasable locking means mechanically connected to the casing and designed to engage the electrical plug to maintain the plug in an operative position. The locking means can be released by a user to allow the plug to be moved to the detached position. The interchangeable plug device of the present invention also incorporates a collapsible prong plug device wherein the prongs are rotatably mounted in the casing and moveable between a collapsed and an extended position.

In a preferred embodiment, a power supply is provided within the casing so that a rechargeable device can be attached to the interchangeable plug device and plugged directly into a wall socket.

A preferred form of locking mechanism is a depressible lock bar which is designed to engage a detent in the casing. The depressible lock bar is connected to or integral with an electrical plug body.

A preferred form of electrical connection is a plurality of submerged pins and sleeves which protects the user against exposure to live current if an interchangeable plug becomes disconnected from a device while the plug is secured to a live electrical socket.

Accordingly, it is an object of this invention to provide an interchangeable plug device.

Another object of this invention is to provide a releasable locking means so that a user can readily release the locking mechanism and move the plug from an operative to a detached position.

Another object of this invention is to provide a plurality of interchangeable plug devices designed to connect to or integrate with a compatible carrier which can be mechanically and electrically connected to an electrical device.

A further object of this invention is provide a means for securing and electrically connecting an interchangeable plug device with a compatible carder in a manner which provides optimal user safety.

Still another object of this invention is to provide an interchangeable plug with collapsible prongs which can be maintained in an extended position.

Yet another object of this invention is to provide a releasable securing means for the extended prongs so that a user can readily release the securing mechanism and move the prongs from an extended to a collapsed position.

DESCRIPTION OF THE PREFERRED EMBODIMENTS

The interchangeable plug device of this invention includes a casing, a plug mounted to the casing, and a locking device. The specific shape of the casing can be modified in many ways to accommodate specific design needs. The plug can also be modified to accommodate specific design needs, including the number and configuration of electrical prongs to adapt to a variety of standard, electrical outlets. The drawings illustrate a representative device but one skilled in the art will recognize that a variety of devices can be designed and manufactured, which are encompassed by the teachings of this invention.

Figure 1A:
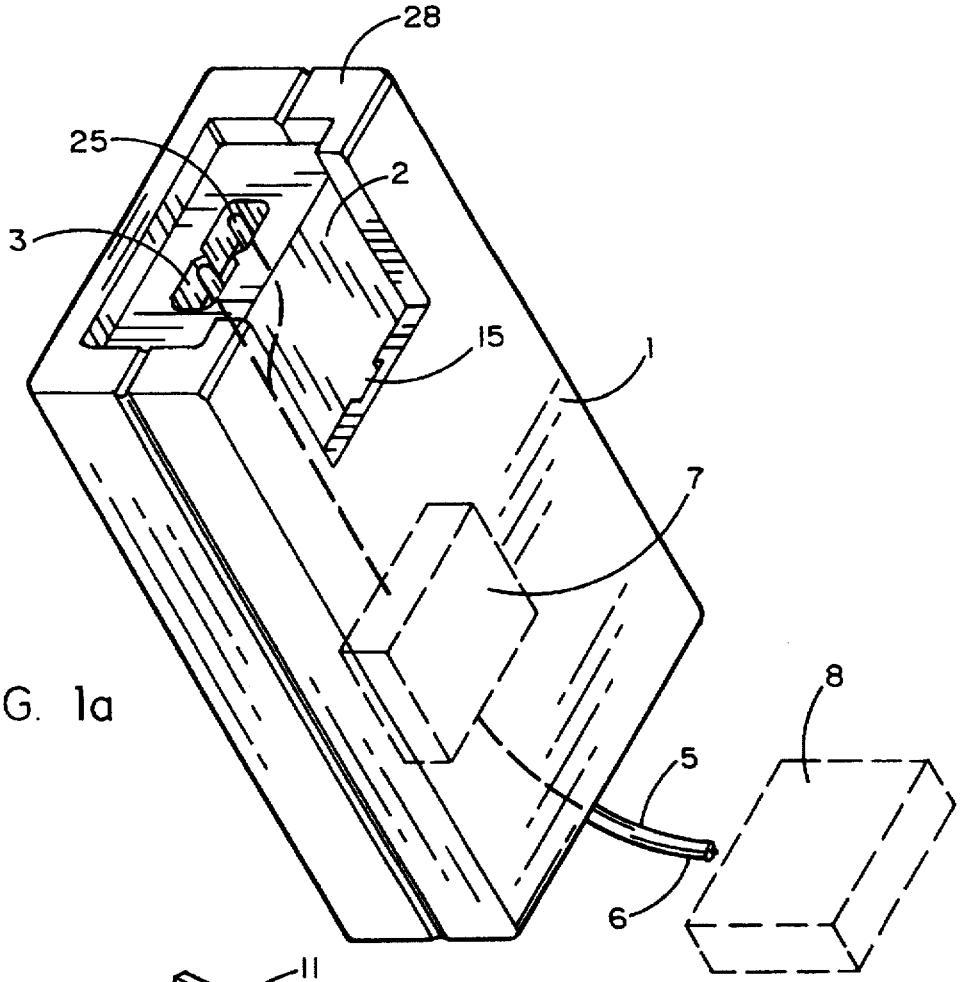
FIGS. 1A, 1B, 1C and 1D illustrate a perspective view of the interchangeable plug device showing several interchangeable plugs positioned to be moved to an operative position.
Figure 1B:
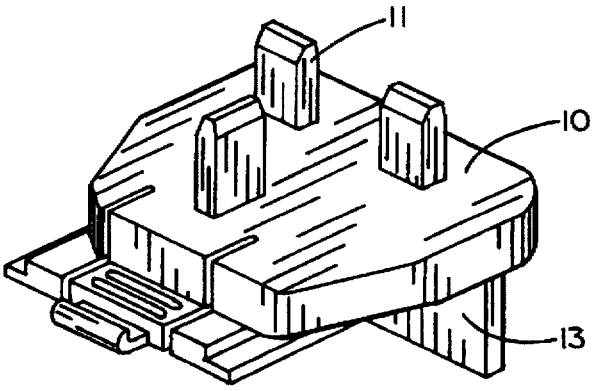
Figure 1C:
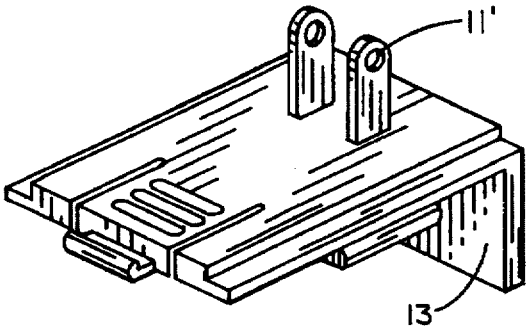
Figure 1D:
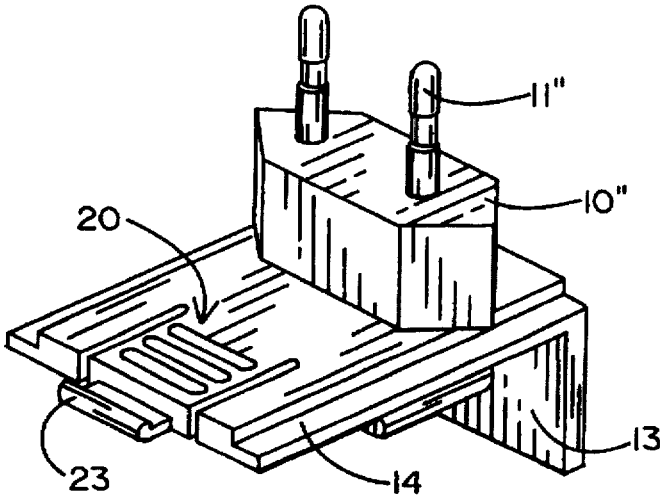
Figure 2:
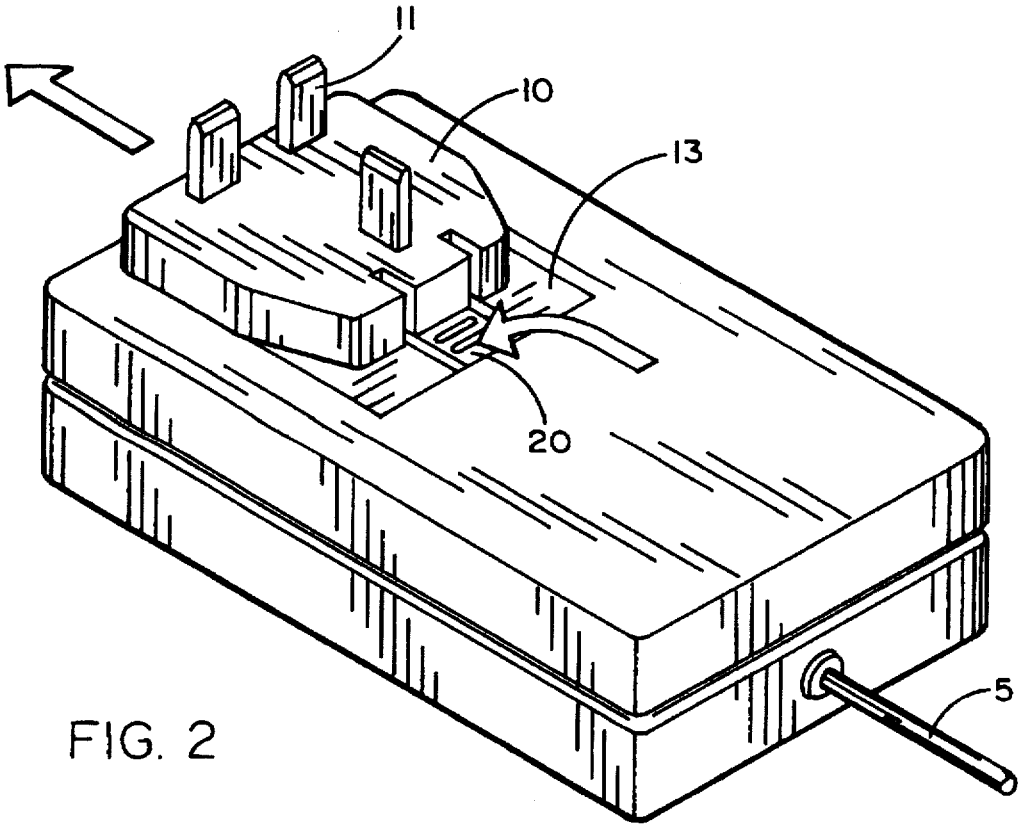
FIG. 2 illustrates a perspective view of the interchangeable plug device showing a representative interchangeable plug in an operative position.

Referring to FIGS. 1A, 1B and 1C, casing 1 includes cavity 2 with channels 28 which are designed to accommodate any one of the carders 13 depicted in the Figures with tongues 14. Similarly, opening 3 with submerged conducting pins 25 are designed to accommodate conducting sleeves 16. In a preferred embodiment, casing 1 is made of high impact thermoplastic material, with top and bottom halves which can be sealed together with ultrasonic bonding.

Figure 4:
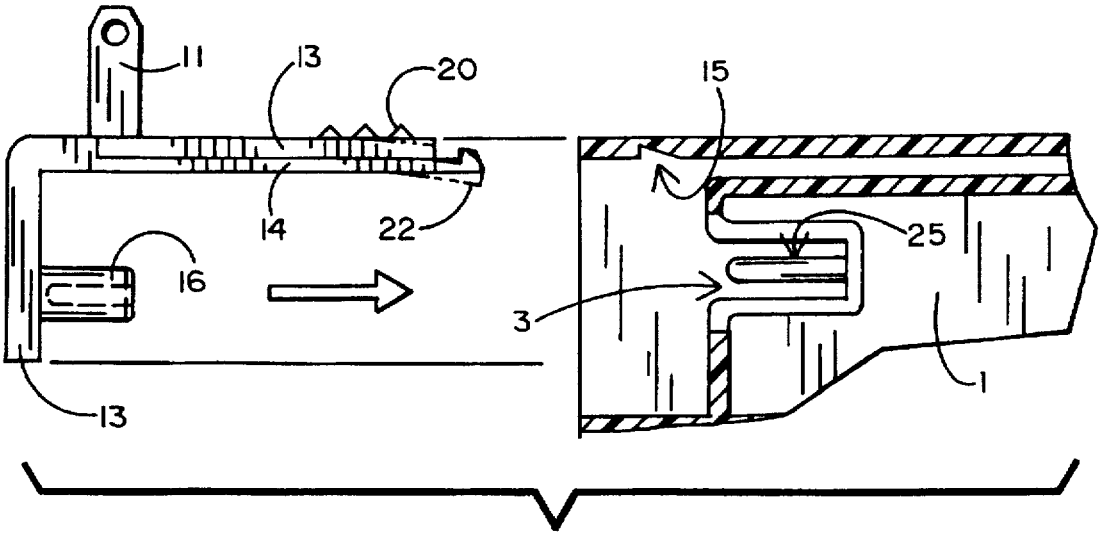
FIG. 4 illustrates a cross-section of the device, showing the plug body and carrier ready to be connected to the device.

Referring to FIG. 4, carder 13 is connected to or integral with prongs 11. Each conducting sleeve 16 within carder 13 is electrically connected to one prong 11 and is designed to mate with a corresponding conducting pin 25 positioned in cavity 3. The conducting pin/sleeve configuration for the electrical contacts of the preferred embodiment increases the safety of the interchangeable plug design by making user contact with a live contact highly unlikely.

In one preferred embodiment, shown in FIG. 1A, power supply 7 is connected to conducting pins 25 and also through electrical cable 5 to an electrical connection means such as power adapter plug 6, which can in turn be connected to an electronic device 8.

FIG. 4 illustrates a cutaway view of a preferred embodiment of the new device. Casing 1 includes various features to support and position various components of the device. Carder 13 is a generally rectangular element with a tongue 14 along each of two sides. Detent 15, shown in greater detail in FIG. 3A, is cut into casing 1.

Figure 3A:
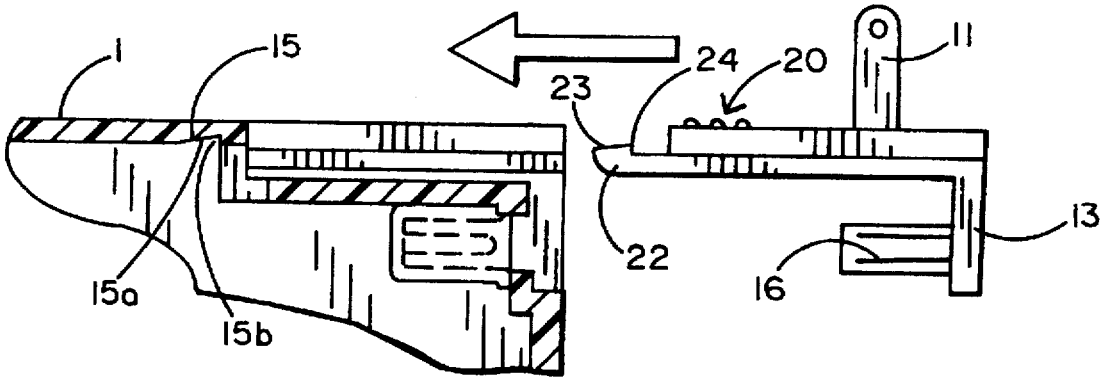
FIGS. 3A, 3B and 3C illustrate a cross-section of the device, showing the plug body and carder ready to be connected to the device (3A), connected (3B) and released and ready to be detached (3C).
Figure 3B:
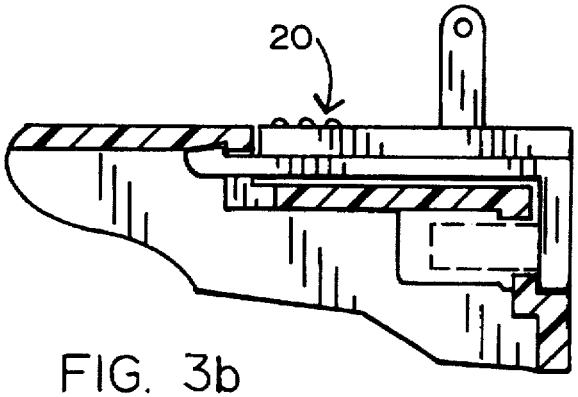
Figure 3C:
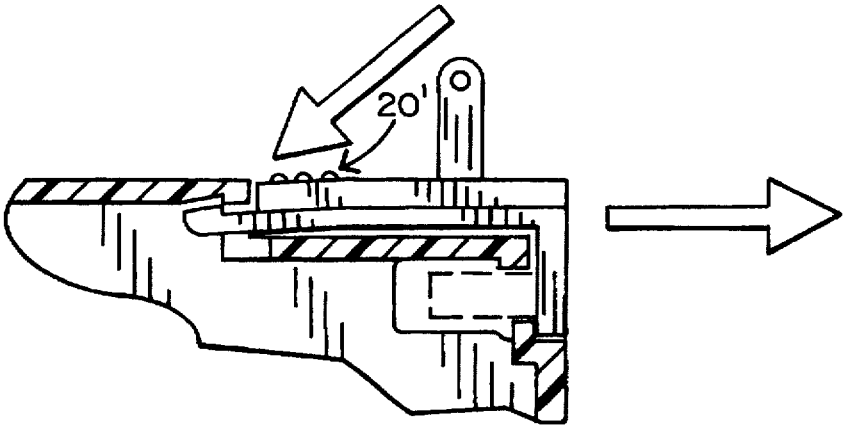

FIGS. 3A, 3B and 3C show lock bar 22 deformably positioned within casing 1. Lock bar 22 is made of a suitable material, such as a plastic material, which is resilient, tends to return to a preferred position, and can be secured at one end and be bent repeatedly to perform the needed release function yet return to a resting position with enough tension to perform the needed latch function. Lock bar 22 is preferably formed integral with carrier 13 and more specifically is integral with tongues 14. Release button 20 is connected to or preferably integral with lock bar 22. Lock bar 22 includes latch 23 and latch tip 24, which are designed to engage detent 15 in casing 1.

When carrier 13 and casing 1 are integrated into a singular unit, lock bar 22 is pressed against casing 1 by the nature tension and resilience of lock bar 22. To release the carrier 13 from the casing 1, release button 20 is depressed, which moves lock bar 22 away from casing 1 and latch 23 and latch 24 away from detent 15. Carder 13 can then be disengaged from casing 1.

Detent 15 is shaped to accommodate the configuration of latch 23 and latch tip 24. In a preferred embodiment, latch 23 is angled as shown to provide a conventional catch mechanism.

Detent 15 includes base 15A which may be generally flat or angled to accommodate latch 23. Detent 15 also includes side 15B which is designed to accommodate and mechanically couple with latch 23 and latch tip 24. Detent 15 may, instead, have two parallel sides on either side of base 15A.

The pressure of lock bar 22 against casing 1 at detent 15 will maintain carrier 13 in the operative position until a user activates release button 20, moving it from the resting position shown in FIG. 3B to a released (depressed) position 20' shown in FIG. 3C. Once the release button is moved and latch tip 24 is removed from detent 15 at least far enough so that carrier 13 can slide freely, the user can move carrier 13 away from casing 1. Although conducting sleeves 16 may remain hot electrical leads after carder 13 is removed, a user or passerby is protected from inadvertent contact with the conducting pins by their submerged position relative to the carder 13.

Collapsible Prong Plug Feature

Figure 5:
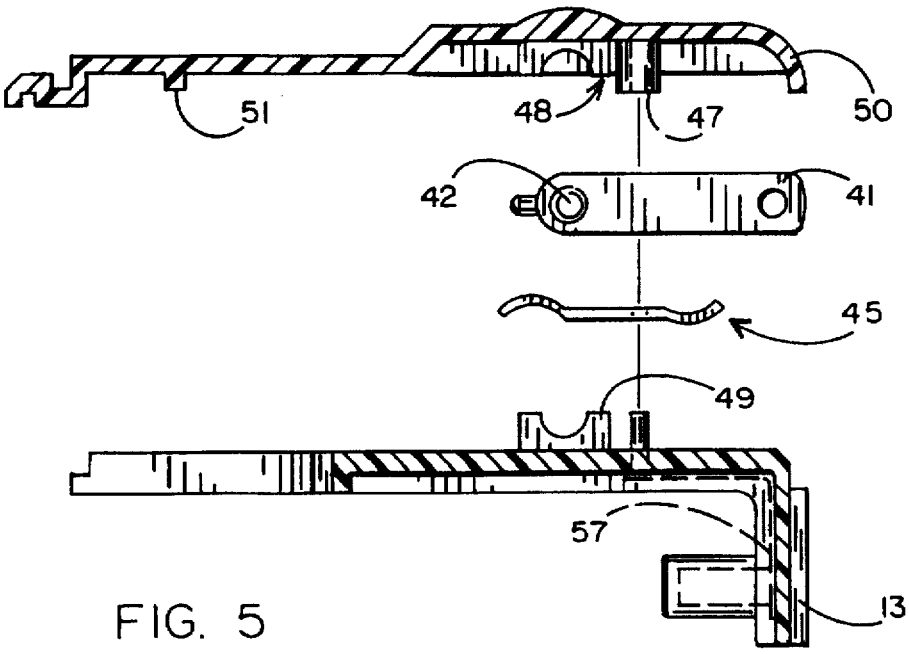
FIG. 5 is an exploded view of a preferred embodiment of the present invention including the collapsible prong feature.
Figure 6:
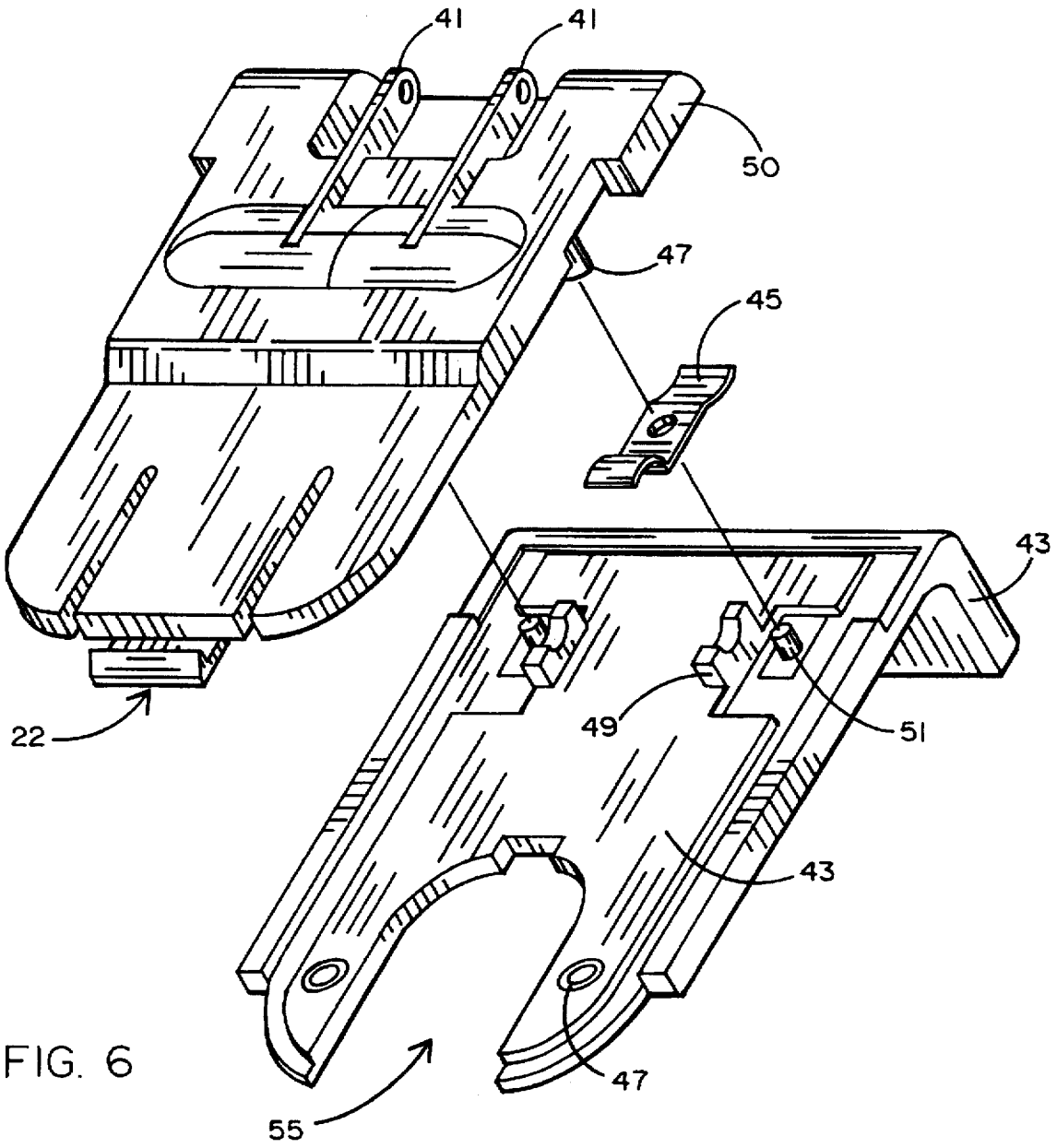
FIG. 6 is a side exploded view of the collapsible prong feature of the present invention.

The collapsible prong plug feature of this invention includes a securing means and a release mechanism integrated into the casing. The prong can be modified to accommodate specific design needs, including the number and configuration of electrical prongs to adapt to a variety of standard electrical outlets. FIGS. 5, 6 and 7 illustrate a representative device, but one skilled in the art will recognize that a variety of devices can be designed and manufactured which are encompassed by the teachings of this invention.

Referring to FIG. 5, an exploded view of carder 13 including the collapsible prong feature of the present invention is shown. Cover plate 50 including lock bar 22 integrally formed therewith, is connected to carrier 13. Encased between cover plate 50 and carrier 13 are collapsible prongs 41 integral with pivot pin 42. Pivot pin 42 rests between upper half-axis 48 and lower half-axis 49. Securing contact springs 45 sit between collapsible prongs 41 and carrier 13. There is preferably at least one securing contact spring for each prong 41. Thus, for the embodiment shown there are two securing contact springs 45.

FIG. 6 provides a more detailed exploded view of the present invention. Male connectors 51 are designed to mate with female connectors 47 in cover plate 50. Securing contact springs 45 preferably fit around male securing members 51 and are thereby secured into position by downward pressure applied from cover plate 50 via female connecting members 47. Gap 55 is formed in carder 13 to accommodate movement of integral lock bar 22 in cover plate 50.

Figure 7A:
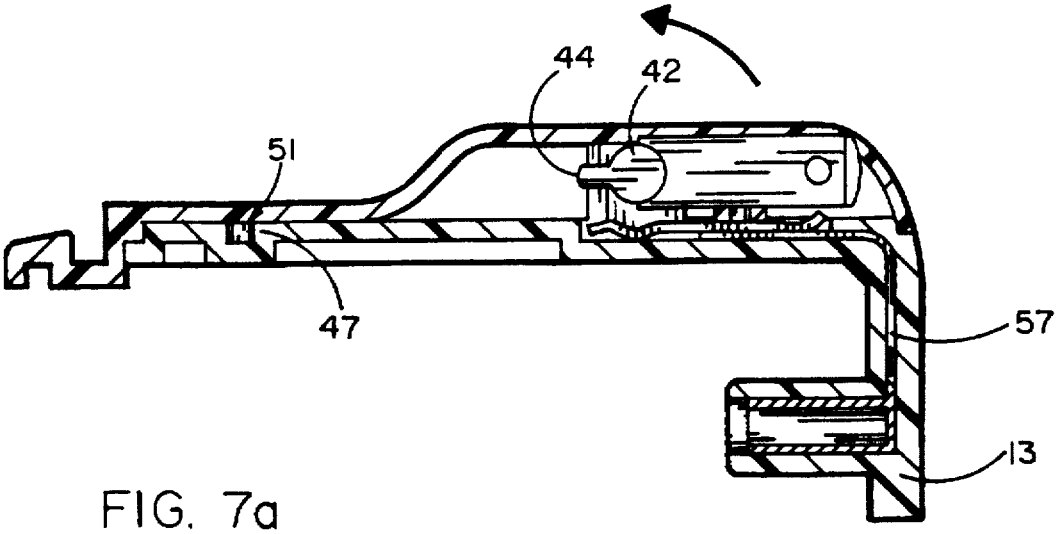
FIGS. 7A, 7B and 7C illustrate a cross-section of the device showing the plug body and carder with the prongs in a fully collapsed position (7A), partially extended position (7B), and fully extended position (7C).
Figure 7B:
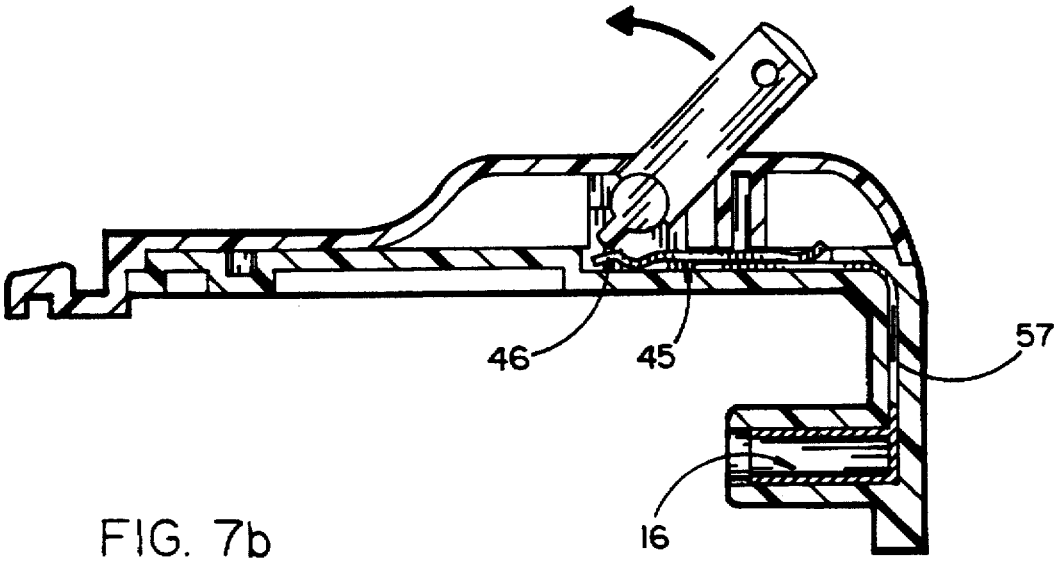
Figure 7C:
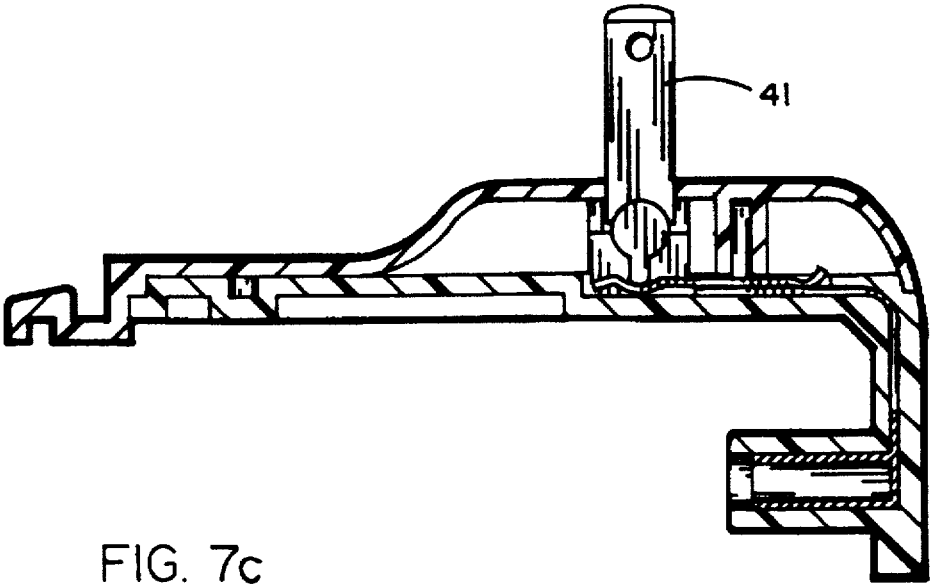

FIGS. 7A, 7B and 7C illustrate cut-away, side views of a preferred embodiment of the new device. Carrier 13 includes connecting line 57 attaching conducting sleeves 16 to each of collapsible prongs 41. Collapsible prongs 41 are integrally formed with pivot pin 42. Also integral with pivot pin 42, cams 44 provide an offset force when the prongs are extended. Referring to FIG. 7B, as collapsible prongs 41 are raised, cams 44 engage rises 46 in securing contact springs 45, thereby causing a frictional force to resist the upward motion of the collapsible prongs. As collapsible prongs 41 reach their full upright and extended position, cams 44 pass completely over rises 46 and are engaged within securing contact spring 45. An unbroken electrical connection is thereby created from collapsible prongs 41 through cams 44 to securing contact springs 42 to wires 57 and to conducting sleeves 66.

If desired, a single cam could be placed on pivot pin 41 with a single securing contact spring 45 positioned nearby to provide resistance via rise 46 and electrical contact with conducting sleeves 66.

A typical collapsible prong plug includes two or three prongs 41. The figures illustrate a typical American plug, but the same teachings and principles can be applied to design and use collapsible prong plug devices for British, European or other plugs, as shown in FIG. 1.

The pressure of securing contact springs 45 will maintain collapsible prongs 41 in the extended position until a user forces the prongs from the extended position shown in FIG. 7C to the collapsed position shown in FIG. 7A. The user must apply sufficient force to move each cam 44 over rise 46, thereby increasing the resistant force of each securing contact spring 45. As cams 44 of prongs 41 disengage securing contact springs 45, electrical contact is broken. Once the cams 44 have passed rises 46 and are free of securing contact springs 45, the user can move prongs 41 to the collapsed position.

Thus, the preferred embodiment of the present invention incorporates the collapsible prong feature into an interchangeable plug incorporating a submerged pin and sleeve electrical connection. With this combination, the present invention provides an improved apparatus and method for deriving electrical current from an outlet meeting any national or international standard, while providing the increased safety and convenience of an easily stored and transported device.

A general description of the device and method of using the present invention as well as a preferred embodiment of the present invention has been set forth above. One skilled in the art will recognize and be able to practice many changes in many aspects of the device and method described above, including variations which fall within the teachings of this invention. The spirit and scope of the invention should be limited only as set forth in the claims which follow.

What is claimed is:

1. An interchangeable plug device comprising a casing, an electrical plug detachably mounted to said casing, said electrical plug including a plurality of prongs, said electrical plug moveable between a detached and an operative position relative to said casing, and a releasable locking means to maintain said electrical plug in said operative position, whereby the electrical plug can be locked into the operative position until and unless a user releases the releasable locking means, said electrical plug having a recessed electrical contact therein for preventing inadvertent contact therewith when said plug is in said detached position, an electrical cable connected to said casing and connectable to said prongs, and an electrical connection means connected to said electrical cable, said electrical connection means designed to provide an electrical connection to a device, whereby said device can be connected to a source of power.

2. An interchangeable plug device comprising a casing, an electrical plug detachably mounted to said casing, said electrical plug including a plurality of prongs, said electrical plug moveable between a detached and an operative position relative to said casing, and a releasable locking means to maintain said electrical plug in said operative position, whereby the electrical plug can be locked into the operative position until and unless a user releases the releasable locking means, said electrical plug having a recessed electrical contact therein for preventing inadvertent contact therewith when said plug is in said detached position wherein said electrical plug includes a prong rotatably mounted thereon, said prong rotatable between a collapsed and an extended position, relative to said casing.

3. The interchangeable plug device of claim 2, wherein said electrical plug includes a securing means to engage said prong in said extended position, whereby the prong can be maintained in the extended position until and unless a user releases the securing means.

4. A power supply with an interchangeable plug and collapsible prong comprising a casing, a power supply mounted within said casing, an electrical plug detachably mounted in said casing, said electrical plug including a plurality of prongs mechanically and electrically connected to said power supply, said electrical plug moveable between a detached and an operative position, relative to said casing, a releasable locking means mechanically connected to said electrical plug to engage said casing and to maintain said electrical plug in said operative position, whereby the electrical plug is locked into the operative position until and unless a user releases the releasable locking means, said electrical plug having a recessed electrical contact therein for preventing inadvertent contact therewith when said plug is in said detached position, said electrical plug having a prong rotatably mounted thereon, said prong rotatable between a collapsed and an extended position, relative to said casing.

5. The power supply of claim 4, wherein said electrical plug includes a securing means to engage said prong in said extended position, whereby the prong can be maintained in the extended position until and unless a user releases the securing means.

6. A battery charger with an interchangeable plug comprising a casing, a power supply mounted within said casing, an electrical plug detachably mounted to said casing, said electrical plug including a plurality of prongs mechanically and electrically connected to said power supply, said electrical plug moveable between a detached and an operative position, relative to said casing, and a releasable locking means to maintain said electrical plug in said operative position, whereby the electrical plug is locked into the operative position until and unless a user releases the releasable locking means, wherein said electrical plug includes a recessed electrical contact therein for preventing inadvertent contact therewith when said plug is in said detached position, and wherein said electrical plug includes a prong rotatably mounted thereon, said prong rotatable between a collapsed and an extended position, relative to said casing.

7. The battery charger of claim 6, wherein said electrical plug includes a securing means to engage said prong in said extended position, whereby the prong can be maintained in the extended position until and unless a user releases the securing means.

* * * * *

UNITED STATES PATENT AND TRADEMARK OFFICE

CERTIFICATE OF CORRECTION

PATENT NO. : 5,634,806

DATED : June 3, 1997

INVENTOR(S) : Hahn

It is certified that error appears in the above-indentified patent and that said Letters Patent is hereby corrected as shown below:

In column 1, line 9, delete the word "an".

In column 2, line 6, delete "wall amounted" and insert therefor --wall-mounted--.

In column 2, line 42, delete the comma after the word "person".

In column 3, line 29, delete "carder" and insert therefor --carrier--.

In column 3, line 49, delete "carder" and insert therefor --carrier--.

In column 3, line 60, delete "carder" and insert therefor --carrier--.

In column 4, line 12, delete "carders" and insert therefor --carriers--.

In column 4, line 18, delete "carder" and insert therefor --carrier--.

In column 4, line 19, delete "carder" and insert therefor --carrier--.

In column 4, line 34, delete "Carder" and insert therefor --Carrier--.

UNITED STATES PATENT AND TRADEMARK OFFICE

CERTIFICATE OF CORRECTION

PATENT NO. : 5,634,806

DATED : June 3, 1997

INVENTOR(S) : Hahn

It is certified that error appears in the above-indentified patent and that said Letters Patent is hereby corrected as shown below:

In column 4, line 55, delete "Carder" and insert therefor --Carrier--.

In column 5, line 7, delete "carder" and insert therefor --carrier--.

In column 5, line 10, delete "carder" and insert therefor --carrier--.

In column 5, line 21, delete "carder" and insert therefor --carrier--.

In column 5, line 38, delete "carder" and insert therefor --carrier--.

Signed and Sealed this

Twenty-sixth Day of August, 1997

*Attest:*

Bruce Lehman

BRUCE LEHMAN

*Attesting Officer*

*Commissioner of Patents and Trademarks*